US010115548B2

(12) United States Patent
Nakamura et al.

(10) Patent No.: US 10,115,548 B2
(45) Date of Patent: Oct. 30, 2018

(54) GAS CIRCUIT BREAKER

(71) Applicant: MITSUBISHI ELECTRIC CORPORATION, Chiyoda-ku, Tokyo (JP)

(72) Inventors: Yasunori Nakamura, Tokyo (JP); Yuji Yoshitomo, Tokyo (JP); Daisuke Yoshida, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 15/538,117

(22) PCT Filed: Jan. 7, 2015

(86) PCT No.: PCT/JP2015/050275
§ 371 (c)(1),
(2) Date: Jun. 20, 2017

(87) PCT Pub. No.: WO2016/110962
PCT Pub. Date: Jul. 14, 2016

(65) Prior Publication Data

US 2018/0012716 A1 Jan. 11, 2018

(51) Int. Cl.
*H01H 33/91* (2006.01)
*H01H 33/08* (2006.01)
*H01H 33/76* (2006.01)

(52) U.S. Cl.
CPC ..... *H01H 33/91* (2013.01); *H01H 33/08* (2013.01); *H01H 33/76* (2013.01)

(58) Field of Classification Search
CPC ..... H01H 33/91; H01H 33/08; H01H 33/42; H01H 33/76
(Continued)

(56) References Cited

U.S. PATENT DOCUMENTS 3,946,183 A * 3/1976 Milianowicz ..... H01H 33/703 218/66
4,276,456 A * 6/1981 Cromer ..... H01H 33/91 218/59
(Continued)

FOREIGN PATENT DOCUMENTS

JP 49-007084 Y1 2/1974
JP 05-190064 A 7/1993
(Continued)

OTHER PUBLICATIONS

International Search Report (PCT/ISA/210) dated Mar. 24, 2015, by the Japanese Patent Office as the International Searching Authority for International Application No. PCT/JP2015/050275.
(Continued)

*Primary Examiner* — Renee Luebke
*Assistant Examiner* — William Bolton
(74) *Attorney, Agent, or Firm* — Buchanan Ingersoll & Rooney PC

(57) ABSTRACT

A gas circuit breaker includes a rod-shaped fixed arc contact, a cylindrical movable arc contact to contact or be separated from the fixed arc contact, a heat puffer chamber storing an arc-extinguishing gas to be blown to an arc generated between the fixed arc contact and the movable arc contact, and an insulator received within a receiving hole formed in a distal end part of the fixed arc contact. An end surface of the insulator on a side of the movable arc contact faces the side of the movable arc contact via an opening end of the housing hole, the end surface on the side of the movable arc contact is disposed closer to the inside of the housing hole than the opening end is, and the insulator is made of an ablation material that is vaporized by heat of the arc.

3 Claims, 5 Drawing Sheets

(58) Field of Classification Search
USPC ..... 218/65, 57, 59, 60, 61, 63, 51
See application file for complete search history.

(56) References Cited

U.S. PATENT DOCUMENTS

| | | | | |
|---|---|---|---|---|
| 4,684,773 | A * | 8/1987 | Niemeyer | H01H 33/98 218/46 |
| 4,935,590 | A * | 6/1990 | Malkin | H01H 33/7076 218/57 |
| 5,304,762 | A | 4/1994 | Hiltbrunner | |
| 5,981,893 | A * | 11/1999 | Bleiker | H01H 1/38 218/48 |
| 2014/0367361 | A1 | 12/2014 | Horinouchi et al. | |

FOREIGN PATENT DOCUMENTS

| | | | |
|---|---|---|---|
| JP | 06-052762 | A | 2/1994 |
| JP | 06-009425 | Y2 | 3/1994 |
| JP | 07-320613 | A | 12/1995 |
| JP | 08-264085 | A | 10/1996 |
| JP | 2002-298711 | A | 10/2002 |
| JP | 2003-297196 | A | 10/2003 |
| JP | 2009-054481 | A | 3/2009 |
| JP | 2011-054369 | A | 3/2011 |
| JP | 2014-071973 | A | 4/2014 |
| WO | WO 2013/118348 | A1 | 8/2013 |

OTHER PUBLICATIONS

Written Opinion (PCT/ISA/237) dated Mar. 24, 2015, by the Japanese Patent Office as the International Searching Authority for International Application No. PCT/JP2015/050275.

Chinese Office Action dated Jun. 15, 2018 issued in corresponding Chinese Patent Application No. 201580071709.3, with English translation (12 pages).

* cited by examiner

GAS CIRCUIT BREAKER

FIELD

The present invention relates to a gas circuit breaker that interrupts a current in an arc-extinguishing gas.

BACKGROUND

Generally, in order to extinguish an arc generated between a movable arc contact and a fixed arc contact at the time of interruption of current, a gas circuit breaker raises gas pressure of an arc-extinguishing gas in a puffer chamber and blows the arc with the pressurized arc-extinguishing gas. More specifically, a gas circuit breaker of a machine puffer type extinguishes the arc by compressing the arc-extinguishing gas in a machine puffer chamber through mechanical motion and blowing the arc with the pressurized arc-extinguishing gas. A gas circuit breaker of a heat puffer type extinguishes the arc by blowing the arc with the arc-extinguishing gas pressurized by arc heat. A system that combines the machine puffer type and the heat puffer type has also been put into practical use.

For the both types above, the higher gas pressure in the puffer chamber provides the improved current interruption performance of the gas circuit breaker. A known technique taught in Patent Literature 1 builds up the gas pressure in the puffer chamber by taking into the puffer chamber a vaporization gas generated from an arc-heated ablation material of a nozzle used for blowing of arc-extinguishing gas. This ablation material, which is, for example, polytetrafluoroethylene, is an insulation material that is decomposed and vaporized by the arc heat.

Patent Literature 2 teaches that an insulator of ablation material is mounted to an inner peripheral side of a distal end part of a rod-shaped fixed contact or an inner peripheral side of cylindrical movable contact.

CITATION LIST

Patent Literature

Patent Literature 1: PCT Patent Application Laid-Open No. 2013/118348

Patent Literature 2: Japanese Patent Application Laid-Open No. 2002-298711

SUMMARY

Technical Problem

For the configuration providing the insulator at the distal end part of the fixed contact as found in Patent Literature 2, unfortunately, a contact point between a metal constituting the fixed contact, the ablation material constituting the insulator, and the arc-extinguishing gas that is an insulation gas is formed at a distal end of the fixed contact. Such a threefold contact point between the metal and the two types of insulation substances having different degrees of permittivity is called a triple junction. The triple junction is known to have a higher electric field intensity than the surroundings.

For the configuration providing the insulator at the distal end part of the fixed contact as found in Patent Literature 2, thus, an electrode gap between the movable contact and the fixed contact, which is intrinsically a high electrical field part, has its electric field intensity further increased due to the formation of the triple junction formed at the distal end of the fixed contact. As a result, a flashover is likely to occur, which leads to reduction in the insulation performance.

For the configuration providing the insulator on the inner peripheral side of the movable contact as found in Patent Literature 2, the increase in the electric field intensity of the gap is suppressed because the triple junction is formed on the inner peripheral side of the movable contact. Unfortunately, the amount of evaporation of the ablation material is suppressed because the insulation body is not exposed to the arc. For this reason, the effect of raising the gas pressure in the puffer chamber is reduced. As a result, the effect of improving the current interruption performance is suppressed.

The present invention has been made in consideration of the above-mentioned circumstances, and an object thereof is to provide a gas circuit breaker capable of improving the current interruption performance while maintaining the insulation performance.

Solution to Problem

To solve the above problem and achieve the object, the present invention provides a gas circuit breaker comprising: a rod-shaped fixed arc contact; a cylindrical movable arc contact to contact or be separated from the fixed arc contact; a puffer chamber storing an arc-extinguishing gas to be blown to an arc generated between the fixed arc contact and the movable arc contact; and an insulator received within a receiving hole formed in a distal end part of one of the fixed arc contact and the movable arc contact, at least a portion of an end surface of the insulator on a side of the other of the fixed arc contact and the movable arc contact facing the other via an opening end formed at the distal end part, the end surface on the side of the other being disposed closer to the one of the fixed arc contact and the movable arc contact than the opening end is, the insulator being made of an ablation material to be vaporized by heat of the arc.

Advantageous Effects of Invention

The present invention provides the effect of improving the current interruption performance while maintaining the insulation performance.

DESCRIPTION OF EMBODIMENTS

Hereinafter, a gas circuit breaker according to an embodiment of the present invention will be described with reference to the accompanying drawings. The present invention is not limited to the following embodiments.

First Embodiment

Figure 1:
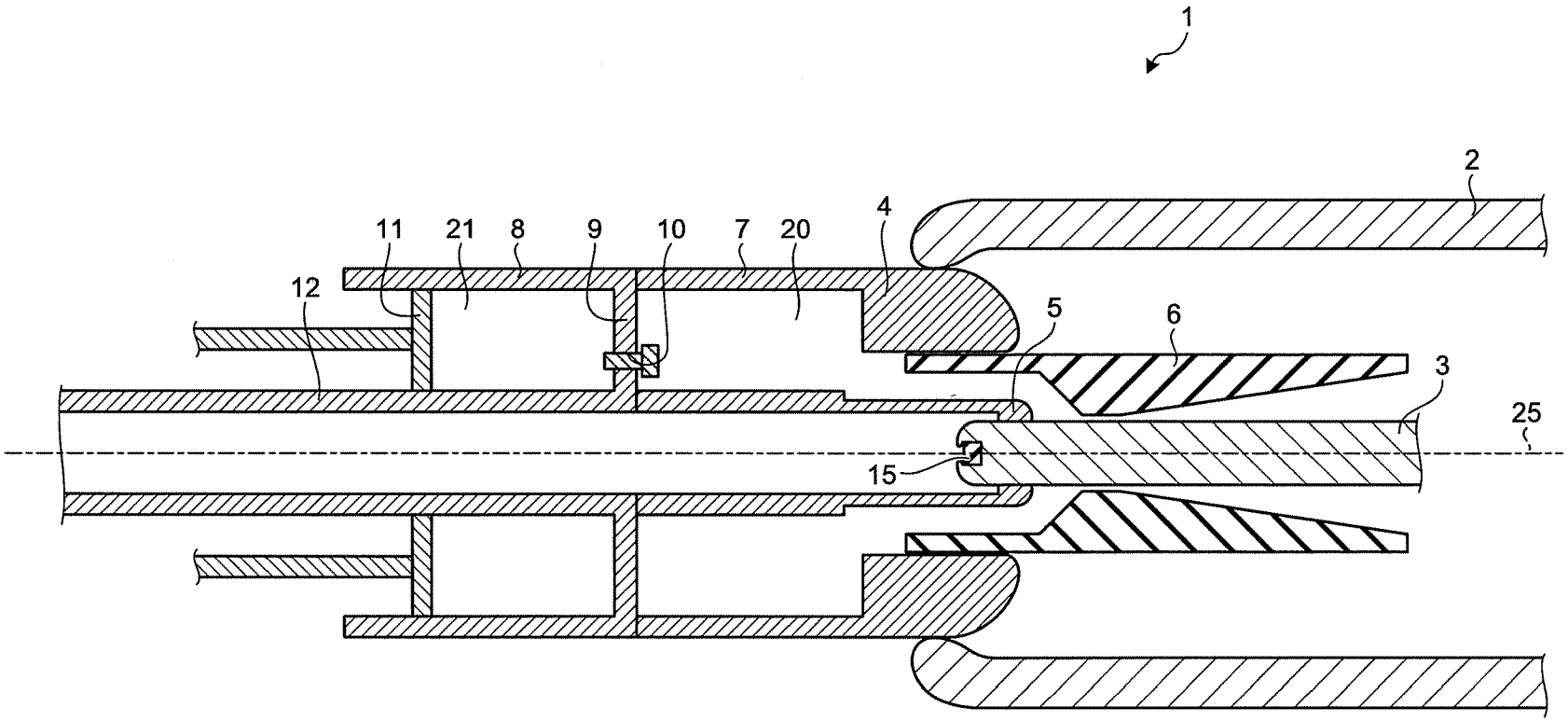
FIG. 1 is a longitudinal cross-sectional view of a gas circuit breaker according to a first embodiment when the gas circuit breaker is in a closed state.
Figure 2:
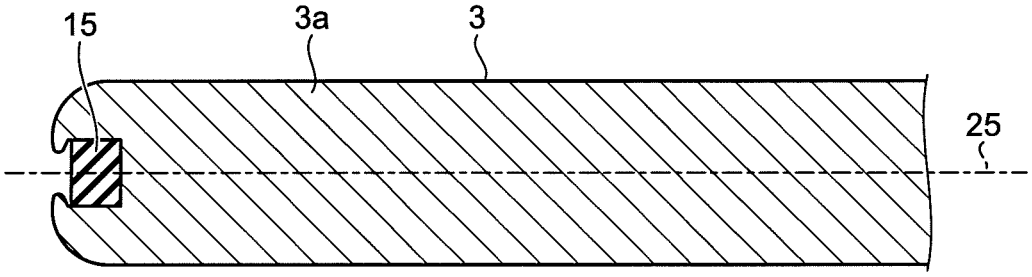
FIG. 2 is a longitudinal cross-sectional view of a fixed arc contact of the first embodiment.
Figure 3:
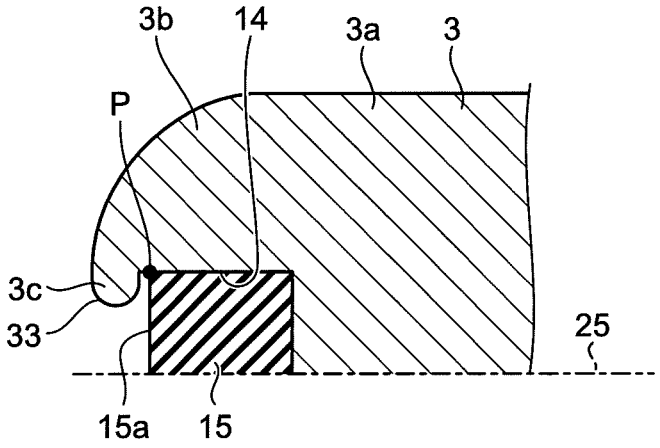
FIG. 3 is a partial enlarged view of a distal end part of the fixed arc contact of the first embodiment.
Figure 4:
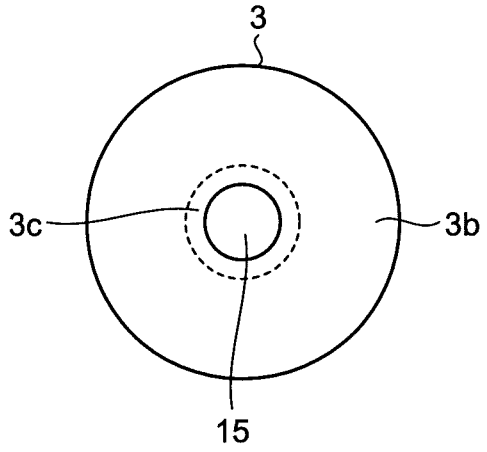
FIG. 4 is a front view of the fixed arc contact of the first embodiment.
Figure 5:
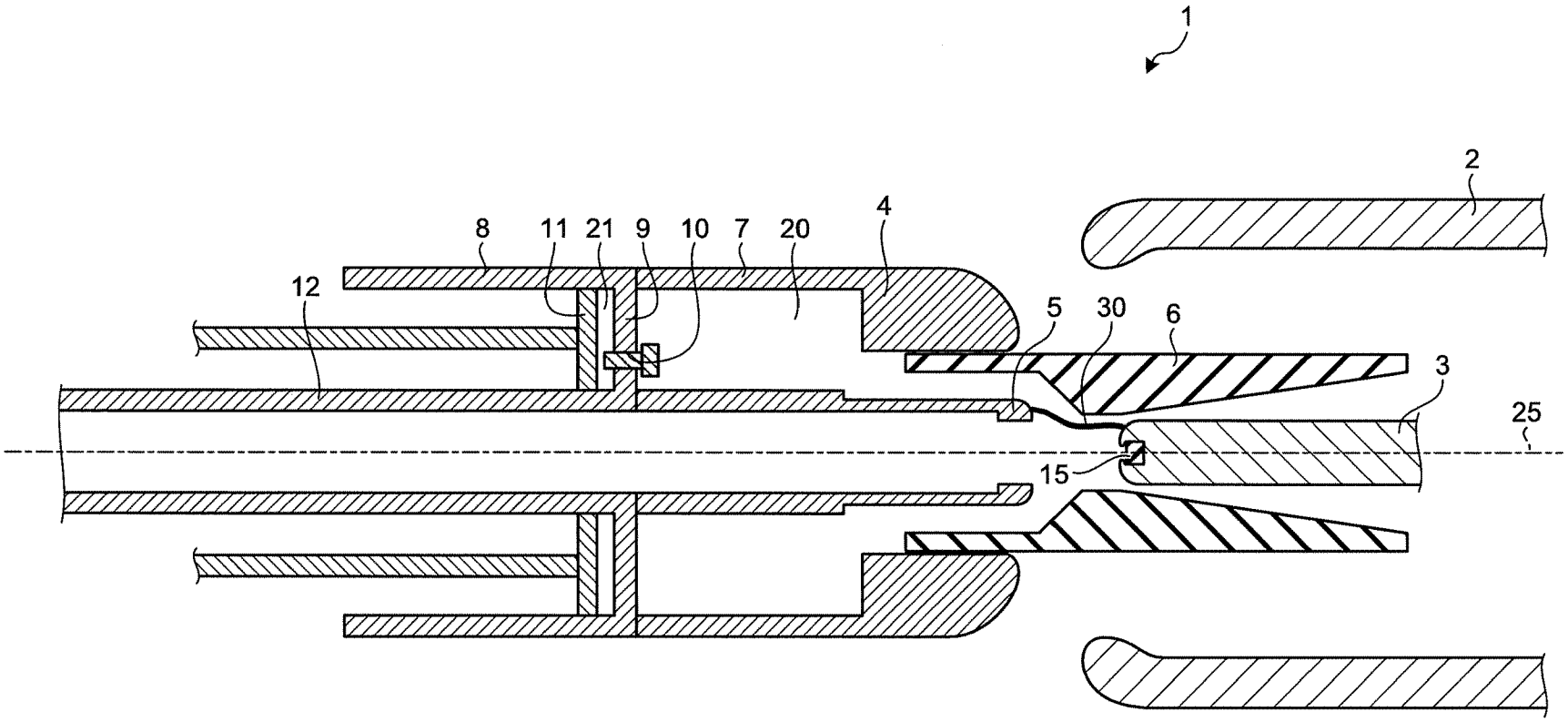
FIG. 5 is a longitudinal cross-sectional view of the gas circuit breaker according to the first embodiment during an interruption operation.

FIG. 1 is a longitudinal cross-sectional view of a gas circuit breaker 1 according to the present embodiment when the gas circuit breaker is in a closed state. FIG. 2 is a longitudinal cross-sectional view of a fixed arc contact 3. FIG. 3 is a partial enlarged view of a distal end part 3*b* of the fixed arc contact 3. FIG. 4 is a front view of the fixed arc contact 3. FIG. 5 is a longitudinal cross-sectional view of the gas circuit breaker 1 according to the present embodiment during an interruption operation.

The gas circuit breaker 1 includes components that constitute an interruption unit. These components include a cylindrical fixed main contact 2, the rod-shaped fixed arc contact 3, a cylindrical rod 12, a bottomed cylindrical puffer cylinder 8, a piston 11, a cylindrical puffer cylinder 7, a movable main contact 4, a movable arc contact 5, and a cylindrical nozzle 6. The fixed arc contact 3 is disposed inside the fixed main contact 2. The rod 12 can reciprocate in a direction of an axis 25. The puffer cylinder 8 is disposed to surround the rod 12 and fixed to the rod 12. The piston 11 fits in the puffer cylinder 8. The puffer cylinder 7 is fixed to the puffer cylinder 8 and disposed closer to the fixed arc contact 3 than the puffer cylinder 8 is. The movable main contact 4 is fixed to an end part of the puffer cylinder 7 on a side of the fixed arc contact 3, and is contactable with or separable from the fixed main contact 2. The movable arc contact 5 is fixed to an end part of the rod 12 on the side of the fixed arc contact 3 and disposed inside the movable main contact 4. The movable arc contact 5 is contactable with or separable from the fixed arc contact 3. The nozzle 6 is fixed to an inner peripheral surface of the movable main contact 4.

The gas circuit breaker 1 is configured by housing the above-mentioned interruption unit in a sealed metal container (not illustrated) filled with an arc-extinguishing gas. The arc-extinguishing gas includes an arc-extinguishing property and an insulation property. In the present embodiment, the arc-extinguishing gas is a sulfur hexafluoride gas.

The fixed main contact 2 is fixed to a fixed side frame (not illustrated). The fixed main contact 2 is formed of metal. In the illustrated example, an inner peripheral side of a distal end part of the fixed main contact 2 is in contact with an outer peripheral side of the movable main contact 4. The distal end part of the fixed main contact 2 as used herein is an end part of the fixed main contact 2 on a side of the movable main contact 4. In the closed state, an alternating current flows between the fixed main contact 2 and the movable main contact 4. A central axis of the fixed main contact 2 coincides with the axis 25. The movable main contact 4 can reciprocate in the direction of the axis 25.

The fixed arc contact 3 is fixed to the above-mentioned fixed side frame. A central axis of the fixed arc contact 3 coincides with the axis 25. The fixed arc contact 3 extends in the direction of the axis 25. The movable arc contact 5 can reciprocate in the direction of the axis 25.

The fixed arc contact 3 includes a columnar proximal part 3*a* and the distal end part 3*b* formed integrally with the proximal part 3*a*. The proximal part 3*a* extends in the direction of the axis 25. A receiving hole 14 that is open to a side of the movable arc contact 5 is formed in the distal end part 3*b*. The distal end part 3*b* as used herein is an end part of the fixed arc contact 3 on the side of the movable arc contact 5. The fixed arc contact 3 is formed of metal.

An insulator 15 is received within the receiving hole 14 formed in the distal end part 3*b*. The insulator 15 has a columnar shape. The receiving hole 14 has a shape that conforms to the shape of the insulator 15. An end surface 15*a* of the insulator 15 on the side of the movable arc contact 5 faces the side of the movable arc contact 5 via an opening end 33 of the receiving hole 14. The end surface 15*a* of the insulator 15 on the side of the movable arc contact 5 is disposed closer to the inside of the receiving hole 14 than the opening end 33 is. In other words, the end surface 15*a* is disposed closer to the fixed arc contact 3 than the opening end 33 is.

The distal end part 3*b* includes a holding part 3*c* that holds the insulator 15 within the receiving hole 14. The holding part 3*c* is provided closer to the movable arc contact 5 than the insulator 15 is. In other words, the entirety of the holding part 3*c* is disposed closer to the movable arc contact 5 than the end surface 15*a* of the insulator 15 on the side of the movable arc contact 5 is. The holding part 3*c* has an annular shape as viewed in plan from the side of the movable arc contact 5, and covers an outer peripheral edge part of the insulator 15. The holding part 3*c* holds the insulator 15 within the receiving hole 14 so that the insulator 15 does not move toward the movable arc contact 5 and fall from the receiving hole 14. The holding part 3*c* has a longitudinal cross section of a smooth non-angular shape.

The insulator 15 is formed of an ablation material. The ablation material is an insulation material that is decomposed and vaporized by heat of an arc 30 into a vaporization gas when the material is heated by the arc 30 generated between the fixed arc contact 3 and the movable arc contact 5.

In the present embodiment, the ablation material that constitutes the insulator 15 contains in its chemical structure a carbon-oxygen bond in a main chain or a cyclic structure without containing a hydrogen atom.

A specific example of such an ablation material containing in its chemical structure the carbon-oxygen bond in the main chain without containing the hydrogen atom is a perfluoroether-based polymer. Specific examples of the perfluoroether-based polymer can include compounds represented by the following chemical formulas (1a), (1b), (1c), (2a), (2b), or (2c).

[Chemical Formula 1]

(1a)

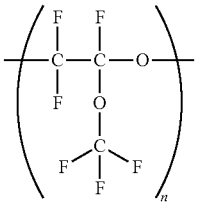

(1b)

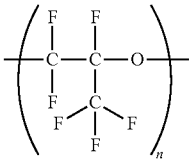

(1c)

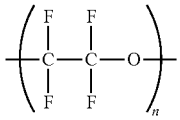

-continued (2a)

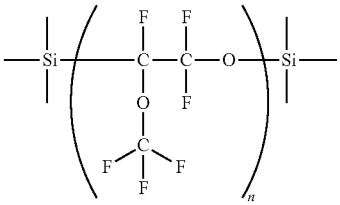

(2b)

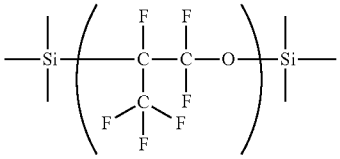

(2c)

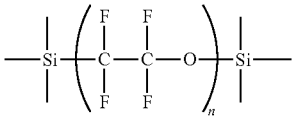

A specific example of such an ablation material containing in its chemical structure the carbon-oxygen bond in the cyclic structure without containing the hydrogen atom is a 4-vinyloxy-1-butene cyclized polymer. Specific examples of the 4-vinyloxy-1-butene cyclized polymer can include compounds represented by the following chemical formulas (3), (4), or (5).

[Chemical Formula 2]

(3)

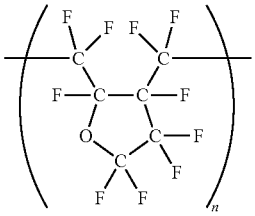

(4)

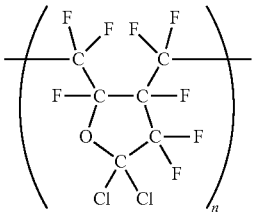

(5)

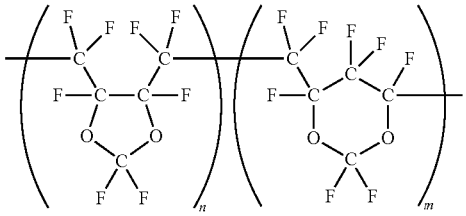

The rod 12 is connected to an operating device (not illustrated), and can reciprocate in the direction of the axis 25 by means of operating force of the operating device. The rod 12 is formed of metal.

The piston 11 is fixed to a movable side frame (not illustrated). The puffer cylinder 8 operates together with the rod 12. A space surrounded by the puffer cylinder 8, the piston 11, and the rod 12 is a machine puffer chamber 21. A space surrounded by a bottom part 9 of the puffer cylinder 8, the puffer cylinder 7, and the rod 12 is a heat puffer chamber 20. The heat puffer chamber 20 and the machine puffer chamber 21 are aligned in series in the direction of the axis 25. The arc-extinguishing gas that is to be blown to the arc 30 is stored in the heat puffer chamber 20 and the machine puffer chamber 21. The bottom part 9 has a check valve 10 provided in a communication hole thereof through which the machine puffer chamber 21 and the heat puffer chamber 20 communicate with each other. The check valve 10 operates so that the arc-extinguishing gas does not flow from the heat puffer chamber 20 to the machine puffer chamber 21. The piston 11 and the puffer cylinders 7, 8 are formed of metal.

A central axis of the movable arc contact 5 coincides with the axis 25. The movable arc contact 5 is configured by a plurality of contact pieces annularly arranged around the axis 25. The movable arc contact 5 is formed of metal. In the illustrated example, an inner peripheral side of a distal end part of the movable arc contact 5 is in contact with an outer peripheral side of the fixed arc contact 3. The distal end part of the movable arc contact 5 as used herein is an end part of the movable arc contact 5 on the side of the fixed arc contact 3. The distal end part 3*b* of the fixed arc contact 3 is not in contact with the movable arc contact 5 and thus does not contribute to the current conduction.

The nozzle 6 is used for blowing of the arc-extinguishing gas and encompasses the movable arc contact 5 and the fixed arc contact 3. The nozzle 6 is formed of the above-mentioned ablation material.

Next, operation of the present embodiment will be described with reference to FIGS. 1 to 5. First, an interruption command is issued with the gas circuit breaker placed in the closed state illustrated in FIG. 1. The operating device (not illustrated) is then driven to cause the rod 12 to move the puffer cylinders 7, 8, the movable main contact 4, the movable arc contact 5, and the nozzle 6 together to the left side of the figure. Since the piston 11 is fixed at this time, the capacity of the machine puffer chamber 21 decreases as illustrated in FIG. 5, thereby increasing the gas pressure in the machine puffer chamber 21. The capacity of the heat puffer chamber 20 remains constant. Even if the gas pressure in the machine puffer chamber 21 is temporarily lower than the gas pressure in the heat puffer chamber 20 during the interruption operation, a gas flow from the heat puffer chamber 20 to the machine puffer chamber 21 does not occur because the check valve 10 is closed.

When the movable main contact 4 and the fixed main contact 2 become separate from each other, and subsequently the movable arc contact 5 and the fixed arc contact 3 become separate from each other, the arc 30 is generated between the movable arc contact 5 and the fixed arc contact 3 as illustrated in FIG. 5. A space formed between the movable arc contact 5 and the fixed arc contact 3 after the movable arc contact 5 becomes separate from the fixed arc contact 3 is called an arc space.

When the arc 30 is generated, the insulator 15 and the nozzle 6 are heated and the above-mentioned ablation material is decomposed and vaporized by the heat of the arc 30, thereby generating the vaporization gas. The vaporization gas flows into the heat puffer chamber 20 and raises the gas pressure in the heat puffer chamber 20. More specifically, the gas pressure in the heat puffer chamber 20 is more pressurized because the vaporization gas generated from the decomposed and vaporized ablation material as well as the sulfur hexafluoride gas pressurized by the heat of the arc 30 is contained in the heat puffer chamber 20. The ablation material, which contains in its chemical structure the carbon-oxygen bond in the main chain or the cyclic structure without containing the hydrogen atom, is decomposed and vaporized due to the carbon-oxygen bond being broken by the heat of the arc 30.

Then, at the zero point of the alternating current, the heating and the pressure increase in the arc space are reduced, and the arc-extinguishing gas is blown from the heat puffer chamber 20 to the arc 30. Furthermore, the check valve 20 is opened when the gas pressure in the machine puffer chamber 21 becomes higher than the gas pressure in the heat puffer chamber 20, such that the arc-extinguishing gas in the machine puffer chamber 21 passes through the communication hole and flows into the heat puffer chamber 20, thereby strengthening the flow of the arc-extinguishing gas blown from the heat puffer chamber 20 to the arc 30 and thus facilitating extinguishment of the arc 30.

In the present embodiment, the receiving hole 14 that is open to the side of the movable arc contact 5 is provided in the distal end part 3*b* of the fixed arc contact 3, the insulator 15 made of the ablation material is received within the receiving hole 14, and the end surface 15*a* of the insulator 15 on the side of the movable arc contact 5 is exposed to the movable arc contact 5 via the opening end 33.

This configuration allows the insulator 15 to be exposed to the arc 30, thereby increasing an amount of vaporization of the ablation material. Since the insulator 15 is disposed adjacent to the arc space, the vaporization gas from the ablation material readily flows into the heat puffer chamber 20. Therefore, the gas pressure in the heat puffer chamber 20 is further raised, thereby improving the current interruption performance.

The insulator 15 is embedded in the distal end part 3*b* of the fixed arc contact 3. The distal end part 3*b* is a portion that does not contribute to the current conduction, and the insulator 15 does not affect the current conduction when the gas circuit breaker is closed.

In the present embodiment, the end surface 15*a* of the insulator 15 on the side of the movable arc contact 5 is disposed closer to the inside of the housing hole 14 than the opening end 33 of the housing hole 14 is. This configuration ensures that a triple junction P formed by the metal constituting the fixed arc contact 3, the insulation material constituting the insulator 15, and the arc-extinguishing gas having the insulation property is located inside the fixed arc contact 3. This suppresses an increase in the electric field intensity between the both arc contacts caused due to the formation of the triple junction P, thereby suppressing a reduction in the insulation performance.

In the present embodiment, the distal end part 3*b* of the fixed arc contact 3 includes the holding part 3*c* disposed closer to the movable arc contact 5 than the insulator 15 is, such that the end surface 15*a* of the insulator 15 on the side of the movable arc contact 5 is disposed closer to the inside of the housing hole 14 than the opening end 33 of the housing hole 14 is.

In the present embodiment, the insulator 15 is held within the housing hole 14 by the holding part 3*c*. Since the insulator 15 is disposed at a position exposed to the arc 30 and the amount of vaporization of the ablation material is large, the insulator 15 is likely to decrease in diameter as the interruption operation is repeated. Even in this case, the presence of the holding part 3*c* eliminates the likelihood that the insulator 15 falls from the receiving hole 14.

Since the insulator 15 is rubbery and deformable, the insulator 15 can be configured to be slightly larger in size than the receiving hole 14 such that the insulator 15 is received within the receiving hole 14 by being pressed into the receiving hole 14. This achieves the facilitation of the attachment of the insulator 15. Alternatively, the insulator 15 can be poured into the receiving hole 14 and cast to be attached to the inside of the receiving hole 14.

In the present embodiment, the ablation material contains in its chemical structure the carbon-oxygen bond in the main chain or the cyclic structure without containing the hydrogen atom. The carbon-oxygen bond contained in the main chain or the cyclic structure of the ablation material is broken by the heat of the arc 30, thereby efficiently decomposing the ablation material into the gas. As a result, the amount of the vaporization of the ablation material increases to thereby further raise the gas pressure in the heat puffer chamber 20. Furthermore, since the ablation material does not contain the hydrogen atom, the vaporization gas does not react with the sulfur hexafluoride gas to generate hydrogen fluoride having a high corrosive property.

The ablation material is not limited to the above-mentioned materials. For example, the ablation material can be polytetrafluoroethylene. The ablation material of the insulator 15 and the ablation material of the nozzle 6 may be different from each other.

Since, in the present embodiment, the gas pressure in the heat puffer chamber 20 is raised by the vaporization gas from the ablation material, there is no need to provide the operating device (not illustrated) with a high output to further raise a gas pressure in the machine puffer chamber 21 as found in the conventional practice. In other words, according to the present embodiment, the current interruption performance can be improved without providing the operating device with the high output. As a result, the cost can be reduced.

In the present embodiment, the gas circuit breaker 1 is a system that combines the machine puffer type and the heat puffer type. However, the gas circuit breaker 1 may be either the machine puffer type or the heat puffer type. In other words, the heat puffer type is obtained by omitting the machine puffer chamber 21 from the configuration in FIG. 1. More specifically, the piston 11 and the puffer cylinder 8 are omitted and the puffer cylinder 7 is closed by an end plate corresponding to the bottom part 9 without the check valve 10. The machine puffer type is obtained by omitting the heat puffer chamber 20 from the configuration in FIG. 1. More specifically, the bottom part 9 is omitted. Both the machine puffer type and the heat puffer type provide the same effect as that provided by the present embodiment because the vaporization gas from the ablation material flows into the machine puffer chamber or the heat puffer chamber to thereby further raise the gas pressure in the machine puffer chamber or the heat puffer chamber.

In the present embodiment, the holding part 3*c* is provided at the distal end part 3*b* in order to prevent the insulator 15 from falling from the receiving hole 14. However, a configuration without the holding part 3*c* can also be employed. Even in this case, the end surface 15*a* of the insulator 15 on the side of the movable arc contact 5 is disposed closer to the inside of the receiving hole 14 than the opening end 33 of the receiving hole 14 is. This can suppress a reduction in the insulation performance while improving the current interruption performance.

The holding part 3*c* does not need to have the annular shape as viewed in plan from the side of the movable arc contact 5, and may be divided in a circumferential direction.

Specifically, the shape of the holding part 3*c* is not limited to the above-mentioned annular shape as viewed in plan, and may be a shape covering a portion of the outer edge part of the insulator 15 as long as the end surface 15*a* of the insulator 15 on the side of the movable arc contact 5 is disposed closer to the inside of the receiving hole 14 than the opening end 33 of the receiving hole 14 is.

In the present embodiment, the shape of the insulator 15 is the columnar shape. However, the shape of the insulator 15 may be a pillar shape other than the columnar shape, and may be a shape other than the pillar shape. In the present embodiment, the arc-extinguishing gas is the sulfur hexafluoride gas. However, other arc-extinguishing gases can also be used.

Second Embodiment

Figure 6:
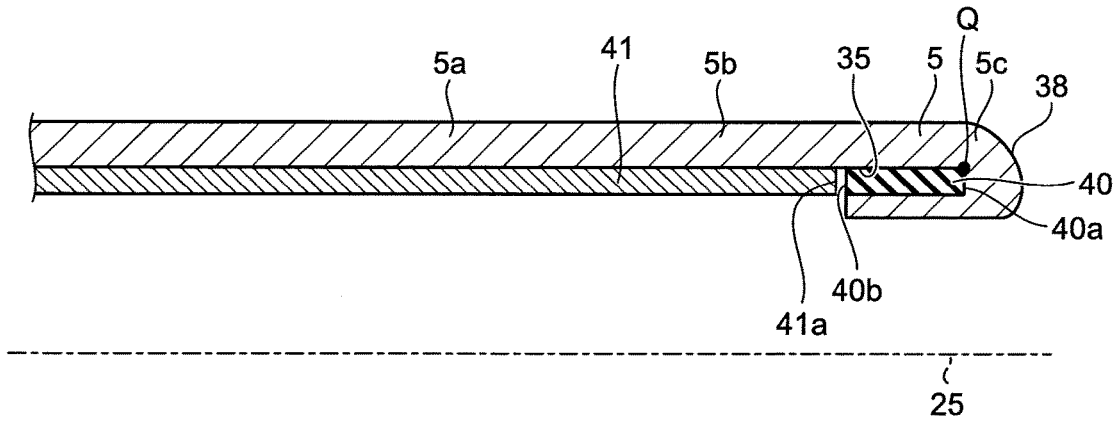
FIG. 6 is a longitudinal cross-sectional view of a movable arc contact of a second embodiment.
Figure 7:
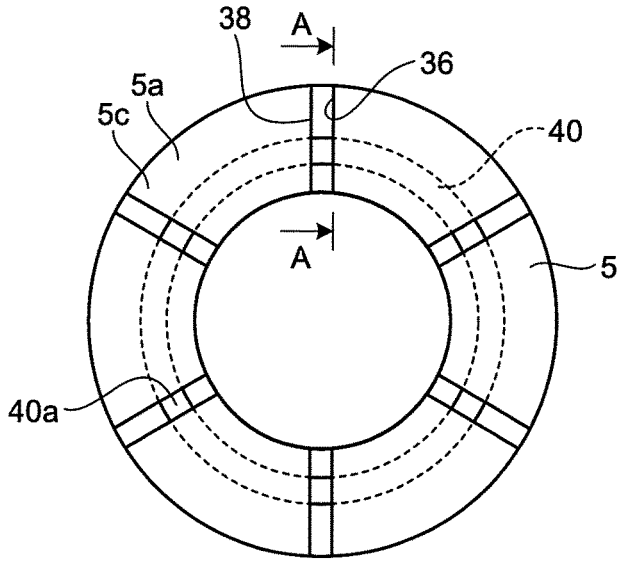
FIG. 7 is a front view of the movable arc contact of the second embodiment.

FIG. 6 is a longitudinal cross-sectional view of the movable arc contact 5 of the present embodiment. FIG. 7 is a front view of the movable arc contact 5 of the present embodiment. FIG. 6 is the longitudinal cross-sectional view taken along line A-A of FIG. 7. The configuration of the present embodiment is the same as that of the first embodiment except the configuration of the movable arc contact 5. In other words, the configuration of the gas circuit breaker 1 is the same as the configuration illustrated in FIG. 1 or 5. Hereinafter, the description will be provided with reference to FIGS. 1 and 5 as well.

The movable arc contact 5 is configured by six contact pieces 5*a* annularly arranged around the axis 25. A slit 36 extending in the direction of the axis 25 is provided between the adjacent contact pieces 5*a*. The slit 36 is formed to extend a constant length from the side of the fixed arc contact 3 to the side of the movable arc contact 5. In other words, the movable arc contact 5 is divided into the six contact pieces 5*a* by the six slits 36 arranged in the circumferential direction around the axis 25 and extending in the direction of the axis 25. The six contact pieces 5*a* are integral with one another at an end part opposite to the side of the fixed arc contact 3.

The movable arc contact 5 includes a proximal part 5*b* and a distal end part 5*c*. The proximal part 5*b* extends in the direction of the axis 25. The distal end part 5*c* is formed integrally with the proximal part 5*b* is larger in radial thickness than the proximal part 5*b*. A receiving hole 35 that is open to an opposite side to the side of the fixed arc contact 3 is formed in the distal end part 5*c*. The distal end part 5*c* as used herein is an end part of the movable arc contact 5 on the side of the fixed arc contact 3.

An insulator 40 is received within the receiving hole 35 formed in the distal end part 5*c*. The insulator 40 has a cylindrical shape. The receiving hole 35 has a shape that conforms to the shape of the insulator 40. Portions of an end surface 40*a* of the insulator 40 on the side of the fixed arc contact 3 face the side of the fixed arc contact 3 via opening ends 38 of the slits 36 on the side of the fixed arc contact 3. The end surface 40*a* is disposed on an opposite side to the side of the fixed arc contact 3 and farther from the side of the fixed arc contact 3 than the opening ends 38 are.

A cylindrical guide 41 is disposed on an inner peripheral surface of the proximal part 5*b* of the movable arc contact 5. The guide 41 is fixed to the proximal part 5*b*. The guide 41 prevents the arc-extinguishing gas from jetting from the heat puffer chamber 20 through the slits 36, and guides the arc-extinguishing gas in the heat puffer chamber 20 to the arc space. The guide 41 also serves as a holding part that holds the insulator 40 in the receiving hole 35. Specifically, an end surface 41*a* of the guide 41 on the side of the fixed arc contact 3 faces an end surface 40*b* of the insulator 40 opposite to the side of the fixed arc contact 3, and an end part of the guide 41 on the side of the fixed arc contact 3 prevents the insulator 40 from falling from the receiving hole 35. More specifically, a distance in the direction of the axis 25 between the end surface 41*a* of the guide 41 on the side of the fixed arc contact 3 and the end surface 40*b* of the insulator 40 opposite to the side of the fixed arc contact 3 is shorter than the length of the insulator 40 in the direction of the axis 25. The end surface 41*a* of the guide 41 on the side of the fixed arc contact 3 and the end surface 40*b* of the insulator 40 opposite to the side of the fixed arc contact 3 may abut on each other. The guide 41 may be formed of metal, or may be formed of an insulation material.

The insulator 40 is formed of an ablation material. The ablation material is an insulation material that is decomposed and vaporized by heat of an arc 30 into an evaporation gas when the material is heated by the arc 30 generated between the fixed arc contact 3 and the movable arc contact 5.

The ablation material that constitutes the insulator 40 contains in its chemical structure a carbon-oxygen bond in a main chain or a cyclic structure without containing a hydrogen atom. A specific example of such an ablation material containing in its chemical structure the carbon-oxygen bond is included in the main chain without containing the hydrogen atom is a perfluoroether-based polymer. A specific example of such an ablation material containing in its chemical structure the carbon-oxygen bond in the cyclic structure without containing the hydrogen atom is a 4-vinyloxy-1-butene cyclized polymer.

Next, operation of the present embodiment will be described with reference to FIGS. 1 to 7. First, an interruption command is issued with the gas circuit breaker placed in the closed state illustrated in FIG. 1. The operating device (not illustrated) is then driven to cause the rod 12 to move the puffer cylinders 7, 8, the movable main contact 4, the movable arc contact 5, and the nozzle 6 together to the left side of the figure. Since the piston 11 is fixed at this time, the capacity of the machine puffer chamber 21 decreases as illustrated in FIG. 5, thereby increasing the gas pressure in the machine puffer chamber 21.

When the movable main contact 4 and the fixed main contact 2 become separate from each other, and subsequently the movable arc contact 5 and the fixed arc contact 3 become separate from each other, the arc 30 is generated between the movable arc contact 5 and the fixed arc contact 3 as illustrated in FIG. 5.

When the arc 30 is generated, the insulators 15, 40 and the nozzle 6 are heated and the ablation material that constitutes the insulators 15, 40 and the nozzle 6 is decomposed and vaporized by the heat of the arc 30, thereby generating the vaporization gas. The vaporization gas flows into the heat puffer chamber 20 and raises the gas pressure in the heat puffer chamber 20. Then, at the zero point of the alternating current, the heating and the pressure increase in the arc space are reduced, and the arc-extinguishing gas is blown from the heat puffer chamber 20 to the arc 30. Furthermore, the check valve 10 is opened when the gas pressure in the machine puffer chamber 21 becomes higher than the gas pressure in the heat puffer chamber 20, such that the arc-extinguishing gas in the machine puffer chamber 21 passes through the communication hole and flows into the heat puffer chamber 20, thereby strengthening the flow of the arc-extinguishing gas blown from the heat puffer chamber 20 to the arc 30 and thus facilitating extinguishment of the arc 30.

In the present embodiment, the receiving hole 35 that is open to the opposite side to the side of the fixed arc contact 3 is provided in the distal end part 5*c* of the movable arc contact 5, the insulator 40 made of the ablation material is received within the receiving hole 35, and the portions of the end surface 40*a* of the insulator 40 on the side of the fixed arc contact 3 is exposed to the side of the fixed arc contact 3 via the opening ends 38 of the slits 36 on the side of the fixed arc contact 3.

This configuration allows the insulator 40 to be exposed to the arc 30, thereby increasing the amount of vaporization of the ablation material that constitutes the insulator 40. Since the insulator 40 is disposed adjacent to the arc space, the vaporization gas from the ablation material that constitutes the insulator 40 readily flows into the heat puffer chamber 20. Therefore, the gas pressure in the heat puffer chamber 20 is raised more than in the first embodiment, thereby further improving the current interruption performance.

In the present embodiment, the end surface 40*a* of the insulator 40 on the side of the fixed arc contact 3 is disposed on the opposite side to the side of the fixed arc contact 3 and farther from the side of the fixed arc contact 3 than the opening ends 38 are. This configuration ensures that a triple junction Q formed by the metal constituting the movable arc contact 5, the insulation material constituting the insulator 40, and the arc-extinguishing gas having the insulation property is located inside the movable arc contact 5. This suppresses an increase in the electric field intensity between the both arc contacts caused due to the formation of the triple junction Q, thereby suppressing a reduction in the insulation performance.

In the present embodiment, the insulator 40 is held in the receiving hole 35 by the guide 41. This eliminates the likelihood that the insulator 40 falls from the receiving hole 35 due to the gas pressure in the arc space and the vibration accompanied by the interruption operation. Since the insulator 40 is disposed at a position exposed to the arc 30 and the amount of vaporization of the ablation material is large, the insulator 40 is likely to decrease in diameter as the interruption operation is repeated. Even in this case, the presence of the guide 41 eliminates the likelihood that the insulator 40 falls from the receiving hole 35.

Since the insulator 40 is rubbery and deformable, the insulator 40 can be configured to be slightly larger in size than the receiving hole 35, such that the insulator 40 is received within the receiving hole 35 by being pressed into the receiving hole 35. This achieves the facilitation of the attachment of the insulator 40.

In the present embodiment, the ablation material that constitutes the insulator 40 contains in its chemical structure the carbon-oxygen bond in the main chain or the cyclic structure without containing the hydrogen atom. However, the ablation material is not limited to this material, and may be another ablation material.

In the present embodiment, the guide 41 is used to prevent the insulator 40 from falling from the receiving hole 35. This eliminates the need to provide a holding part separately from the guide 41, thereby reducing the number of components and hence the cost. Alternatively, a holding part that is different from the guide 41 can be provided.

A configuration without the holding part for holding the insulator 40 in the housing hole 35 can also be employed. For example, the guide 41 can be provided on an outer peripheral surface of the movable arc contact 5. Even in this case, the end surface 40*a* of the insulator 40 on the side of the fixed arc contact 3 is disposed on the opposite side to the side of the fixed arc contact 3 and farther from the side of the fixed arc contact 3 than the opening ends 38 are. This can suppress a reduction in the insulation performance while improving the current interruption performance.

In the present embodiment, the shape of the insulator 40 is the cylindrical shape. However, the insulator 40 may be divided in the circumferential direction. Specifically, the insulator 40 only needs to be disposed such that at least a portion of the end surface 40*a* faces the side of the fixed arc contact 3 via the opening end 38, regardless of the specific shape.

In the present embodiment, the number of contact pieces 5*a* is six. However, the number of contact pieces 5*a* is not limited to this number, and only needs to be plural.

A configuration, operation, and an effect of the present embodiment other than those described above are the same as those in the first embodiment.

Although in the present embodiment, the configuration in which the insulator 15 is provided at the distal end part 3*b* of the fixed arc contact 3 and the insulator 40 is provided at the distal end part 5*c* of the movable arc contact 5, a configuration in which the insulator 15 is not provided at the distal end part 3*b* of the fixed arc contact 3 and the insulator 40 is provided at the distal end part 5*c* of the movable arc contact 5 can also be employed. Even in this case, the effect similar to the above-mentioned one can be obtained.

The first and second embodiments can be summarized as follows. That is, a gas circuit breaker according to the present invention comprising: a rod-shaped fixed arc contact; a cylindrical movable arc contact to contact or be separated from the fixed arc contact; a puffer chamber storing an arc-extinguishing gas to be blown to an arc generated between the fixed arc contact and the movable arc contact; and an insulator received within a receiving hole formed in a distal end part of one of the fixed arc contact and the movable arc contact, at least a portion of an end surface of the insulator on a side of the other of the fixed arc contact and the movable arc contact facing the other via an opening end formed at the distal end part, the end surface on the side of the other being disposed closer to the one of the fixed arc contact and the movable arc contact than the opening end is, the insulator being made of an ablation material to be vaporized by heat of the arc.

The configuration described in the above-mentioned embodiments indicates an example of the contents of the present invention. The configuration can be combined with another well-known technique, and a part of the configuration can be omitted or changed without departing from the spirit and scope of the present invention.

REFERENCE SIGNS LIST

1 gas circuit breaker, 2 fixed main contact, 3 fixed arc contact, 3*a* proximal part, 3*b* distal end part, 3*c* holding part, 4 movable main contact, 5 movable arc contact, 5*a* contact piece, 5*b* proximal part, 5*c* distal end part, 6 nozzle, 7, 8 puffer cylinder, 9 bottom part, 10 check valve, 11 piston, 12 rod, 14, 35 receiving hole, 15, 40 insulator, 15*a*, 40*a*, 40*b*, 41*a* end surface, 20 heat puffer chamber, 21 machine puffer chamber, 25 axis, 30 arc, 33, 38 opening end, 36 slit, 41 guide.

The invention claimed is:

1. A gas circuit breaker comprising:

a rod-shaped fixed arc contact;

a cylindrical movable arc contact to contact or be separated from the fixed arc contact, the movable arc contact having a plurality of contact pieces on a side of the fixed arc contact, the contact pieces being separated from one another by a plurality of slits arranged in a circumferential direction of the movable arc contact and extending in an axial direction of the movable arc contact, each of the contact pieces having a proximal part and a distal end part larger in thickness than the proximal part, the distal end part of each contact piece including a bend having opposed walls extending in the axial direction of the movable arc contact, the distal end parts of the plurality of contact pieces having receiving holes, each of the receiving holes being defined between the opposed walls of a corresponding one of the distal end parts;

a puffer chamber storing an arc-extinguishing gas to be blown to an arc generated between the fixed arc contact and the movable arc contact; and an insulator received within the receiving holes, the receiving holes being open to an opposite side to a side of the fixed arc contact, a portion of an end surface of the insulator on the side of the fixed arc contact facing the side of the fixed arc contact via opening ends of the slits on the side of the fixed arc contact, the end surface on the side of the fixed arc contact being disposed on the opposite side to the side of the fixed arc contact and farther from the side of the fixed arc contact than the opening ends are, the insulator being made of an ablation material to be vaporized by heat of the arc.

2. The gas circuit breaker according to claim 1, wherein a cylindrical guide is provided on an inner peripheral surface of the movable arc contact, and the guide holds the insulator within the receiving hole, an end surface of the guide on the side of the fixed arc contact faces an end surface of the insulator opposite to the side of the fixed arc contact.

3. The gas circuit breaker according to claim 1, wherein the ablation material contains in a chemical structure thereof a carbon-oxygen bond in a main chain or a cyclic structure without containing a hydrogen atom.

* * * * *